United States Patent [19]

Shimazaki

[11] 4,188,893

[45] Feb. 19, 1980

[54] DEVICE OF DETECTING CLOTH FEEDING AMOUNT IN SEWING MACHINES

[76] Inventor: Fumio Shimazaki, No. 96, Mizubashiri, Higashiosaka-shi, Osaka-fu, Japan

[21] Appl. No.: 937,277

[22] Filed: Aug. 28, 1978

[51] Int. Cl.[2] ..... D05B 19/00; D05B 27/22

[52] U.S. Cl. ..... 112/121.11; 112/158 E; 112/314

[58] Field of Search ..... 112/121.11, 121.12, 112/121.15, 158 E, 314, 316, 317

[56] References Cited

U.S. PATENT DOCUMENTS

| | | | |
|---|---|---|---|
| 3,459,144 | 8/1969 | Ramsey et al. | 112/121.11 |
| 3,459,145 | 8/1969 | Ramsey et al. | 112/121.11 |
| 3,654,882 | 4/1972 | Kamena | 112/121.11 |
| 4,141,305 | 2/1979 | Takenoya et al. | 112/158 E |
| 4,147,118 | 4/1979 | Adams | 112/158 E |
| 4,149,476 | 4/1979 | Wurst et al. | 112/158 E |

*Primary Examiner*—H. Hampton Hunter
*Attorney, Agent, or Firm*—Michael J. Striker

[57] ABSTRACT

In preparing for the sewing of fancy or complicated stitch patterns, on a sewing machine provided with a feed dog able to feed sewn material both forwards and backwards and also provided with a transversely shiftable needle for implementation of zig-zag effects, the sewing machine is operated as if to sew the stitch pattern desired, but without any cloth actually present beneath the machine's needle. The movement of the machine's feed dog and the transverse or zig-zag shifting of the machine's needle are both detected by transducers which generate corresponding electrical signals. These signals are processed and converted into a form suitable for application to the x- and y-inputs of an x-y recorder, which then generates a display of what the thusly simulated stitching pattern will look like when actually stitched on cloth. The transverse shifting of the machine's needle is readily detected and unproblematic because of its definiteness. The cloth-feeding operation performed by the feed dog, however, is problematic, due to the inherently indefinite operation of cloth feeders, uncontrollable displacements of sewn material during feed-direction reversals, etc. Accordingly, to generate the data needed for simulation of cloth feed action, the invention utilizes an attachment which includes endless belts physically engaged by the feed dog and used to simulate the presence of cloth being sewn. All this makes it unnecessary to waste workpieces during the trial-and-error work involved in preparing for the stitching of a complex or fancy stitch pattern.

9 Claims, 11 Drawing Figures

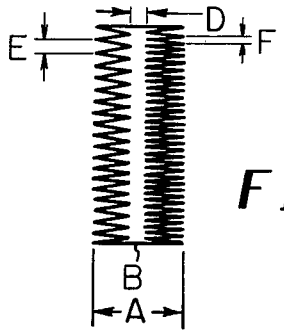
FIG. 2a
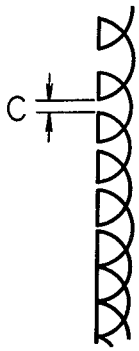
FIG. 2b
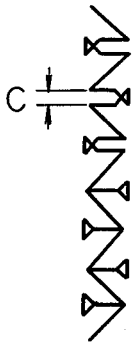
FIG. 2c
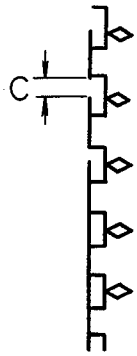
FIG. 2d
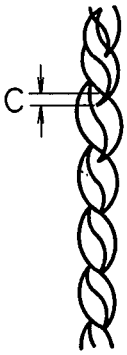
FIG. 2e
FIG. 3
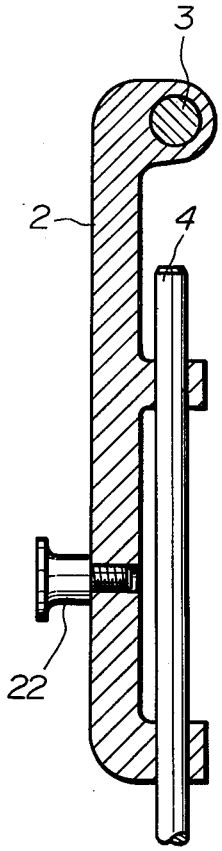
FIG. 4
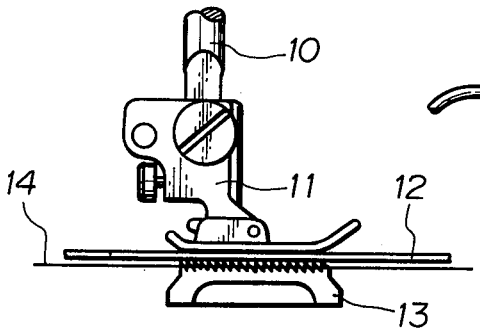
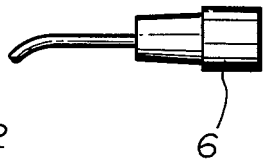
FIG. 5
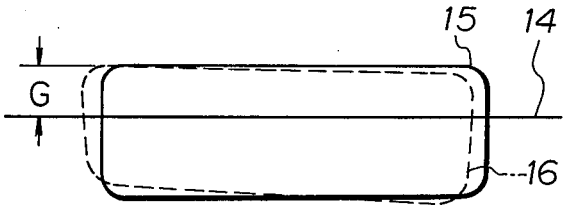

DEVICE OF DETECTING CLOTH FEEDING AMOUNT IN SEWING MACHINES

BACKGROUND OF THE INVENTION

In zig-zag sewing machines, the sewing needle, in addition to its usual vertical reciprocability, is transversely shiftable for implementation of zig-zag stitching effects, and also still more complicated stitch patterns. Also, the feed dog of the machine's cloth feeder is generally designed to be able to implement both forwards and reverse feed of sewn material. Complex or otherwise problematic stitch patterns are implemented by transversely shifting the machine's needle to predetermined positions, and by operating the feed dog to implement forwards or backwards cloth feed by predetermined increments, in preparation for each needle penetration to be performed during the ongoing course of sewing a complex or problematic stitch pattern. Even assuming that the amount by which the needle is transversely shifted and the sewn material fed forwards or backwards by the feed dog in preparation for each needle penetration can both be absolutely controled, implementation of complex stitch patterns requires good judgement in the dimensional matching of this combination of needle-shift and cloth-feed amounts for each successive needle penetration and, more difficult, of all such combinations of amounts for all the successive needle penetrations of the whole stitch pattern to be implemented. Typically, this is not done, for example, using a pencil and graph paper in the planning stage, but instead is worked out on cloth workpieces during actual sewing of such workpieces, i.e., proceeding on a trial-and-error basis.

Actually, there is no other feasible approach to the planning or setting-up of a complex stitch pattern; for example, plots of needle-penetration locations on graph paper are in general quite inadequate for such preliminary work. The reasons for this situation are, of course, familiar to persons skilled in the art. In principle, the transversely displaced position to which the machine's needle is to be shifted prior to the next constituent needle penetration involved in a stitch pattern can, on most zig-zag sewing machines, be predetermined with a very high degree of definiteness; and to this extent, plotting of the successive needle-penetration points of a fancy stitch pattern on graph paper or the like would, in principle, be meaningful. However, where the geometry or configuration of the stitch pattern to be implemented depends upon the feeding of the sewn cloth by non-constant increments for the successive needle penetrations of the pattern or, even worse, where cloth-feed direction reversals are necessary for implementing the pattern, the situation becomes very problematic.

It is a notorious problem in the art that the amounts by which a sewing machine's cloth-feeding feed dog incrementally advances the material being sewn are very difficult to predetermine. To implement successive increments of cloth feed of successive different amounts for the successive needle penetrations, it is of course typical to correspondingly adjust the machine's cloth-feed unit for each successive stitch. However, the simple fact is that, although the cloth-feed unit is nominally adjusted to implement the cloth-feed increments required, the cloth-feed increments physically obtained simply do not match those which have been thusly set on the machine's feeding mechanism; this is due to problems of uncontrollable cloth shifting during cloth feed, and in general due to problems of inherently indefinite operation, or indefinite adjustability, of sewing-machine cloth feeders. The situation is greatly worsened when feed-direction reversals are necessitated. Even if the amount of the cloth-feed increment is kept constant, when one cloth-feed increment is performed, followed by a needle penetration, followed by a nominally identical cloth-feed increment in the opposite feeding direction, the opposite-direction feed increment which actually results will, most often, simply not be of the same magnitude as the previous one. This is a very well known problem in the art.

As a result, considerable amounts of trial-and-error work, performed on actual workpieces, is typically necessary, in the course of setting-up for the sewing of a particular stitch pattern.

By way of example, attention is directed to the stitch patterns depicted in FIGS. *2a–2e*.

FIG. *2a* depicts a conventional buttonhole stitch pattern. As is well known, an acceptable buttonhole stitch pattern involves proper establishment of the cloth-feed increment E used for the left-side line-tack stitches, proper establishment of the cloth-feed increment F used for the right-side line-tack stitches, proper establishment of the zig-zag amplitude A employed for the upper bar-tack stitches and for the lower bar-tack stitches B, and proper establishment of the width D of the central unstitched zone on the sewn material where the buttonhole slit is to be formed. As is extremely well known, even if the amount of the cloth-feed increment used for one of the two sets of line-tack stitches is again utilized during the opposite-direction feeding of cloth performed during the sewing of the other set of line-tack stitches, the amount of the reverse-direction feed increment actually achieved will often be different, leading to differing numbers of constituent stitches for the left and for the right rows of line-tack stitches.

FIGS. *2b–2e* depict four different stitch patterns, complex ones requiring frequent reversals of the cloth-feed direction. In each of these four Figures, at the bottom of the Figure the stitch pattern is shown sewn correctly, and at the top of the Figure there is shown the sort of difficulties which arise during the course of trying to achieve the respective stitch pattern. In FIG. *2b*, because of the problematic controllability of the amount of the cloth-feed increment encountered upon feed-direction reversals, a gap, of length C measured in the cloth-feed direction, develops within the stitch pattern. Similar gaps, their lengths likewise designated by C, are shown developed in the stitch patterns depicted in FIGS. *2c* and *2d*. In FIG. *2e*, which depicts a so-called "leaf" pattern, the pattern as it should appear is depicted at the lower part of the Figure. The problem arising is depicted at the upper part of the Figure and is here constituted, not by a gap of length C, but instead by a backwards-going overlap of length C; i.e., the lower tips of successive "leaves" of the so-called "leaf" pattern are improperly extending into the bodies of their neighboring "leaves". When a stitch pattern as complicated as that of FIG. *2e* is involved, i.e., involving a cloth-feed increment whose magnitude changes for almost each successive one of the constituent needle penetrations, the trial-and-error work involved in getting this stitch pattern to "go right" is very considerable indeed.

SUMMARY OF THE INVENTION

The invention contemplates a system in which the preliminary setting-up work involved in the establishment of a fancy stitch pattern is generally facilitated, and can be performed without actually placing any cloth beneath the needle of the sewing machine used for the setting-up work. Electrical transducers sense the transversely displaced position of the machine's needle and also the operation of the machine's feed dog and generate corresponding electrical signals. These electrical signals are then converted into a form suitable for application to the x- and y-inputs of an x-y recorder, such as a recording oscilloscope. The operator pretends to sew the desired stitch pattern, without cloth actually present beneath the needle, and a display of the stitch pattern which results appears on the screen of the oscilloscope. This makes for more convenient and also more precise analysis of the problems discussed above; for example, the scale of the oscillope-screen display of the stitch pattern can be made much larger than the size of the stitch pattern actually to be sewn on the cloth.

The use of an electrical transducer to sense the transversely displaced position of the machine's needle is relatively unproblematic. The amount of needle displacement involved for each needle penetration is a characteristic of the operation of the machine per se and can be directly sensed.

In contrast, the movements performed by the feed dog of the machine's cloth-feeder unit are, as already stated and notoriously well known in the art, no sufficiently direct indication of what movements will be performed when cloth is actually present in the machine, especially when recurring feed-direction reversals are involved.

Accordingly, the present invention contemplates a special transducer for generating, without the presence of a workpiece beneath the machine's needle, the requisite electrical signals indicative of cloth-feed increment.

In accordance with this aspect of the present invention, use is made of a cloth-feed transducer comprising one or more components which are physically engaged by the feed dog of the machine's cloth-feeder unit, such components serving to simulate the physical presence of a workpiece being sewn.

In the presently preferred embodiment of the invention, use is made of an attachment provided with endless belts which are gripped by the machine's cloth-feeder unit, and driven by the cloth-feeder unit forwards and backwards in the same way as a workpiece being sewn. The movements imparted to such belts are then converted into electrical signals, which can be applied to one of the inputs of the x-y display device employed.

Figure 1:
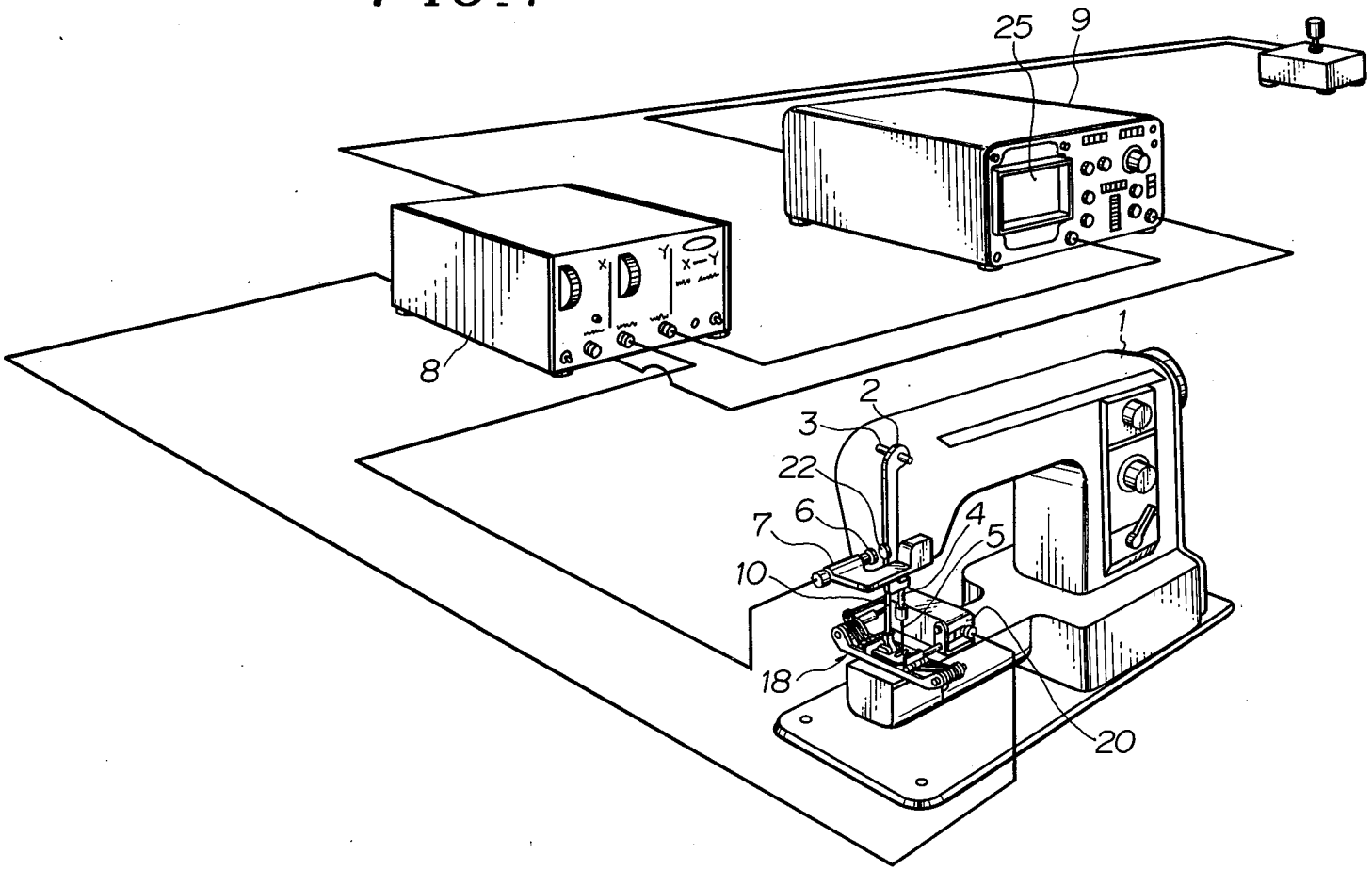
FIG. 1 is a perspective depiction illustrating the overall appearance of the type of system contemplated by the invention.
Figure 6:
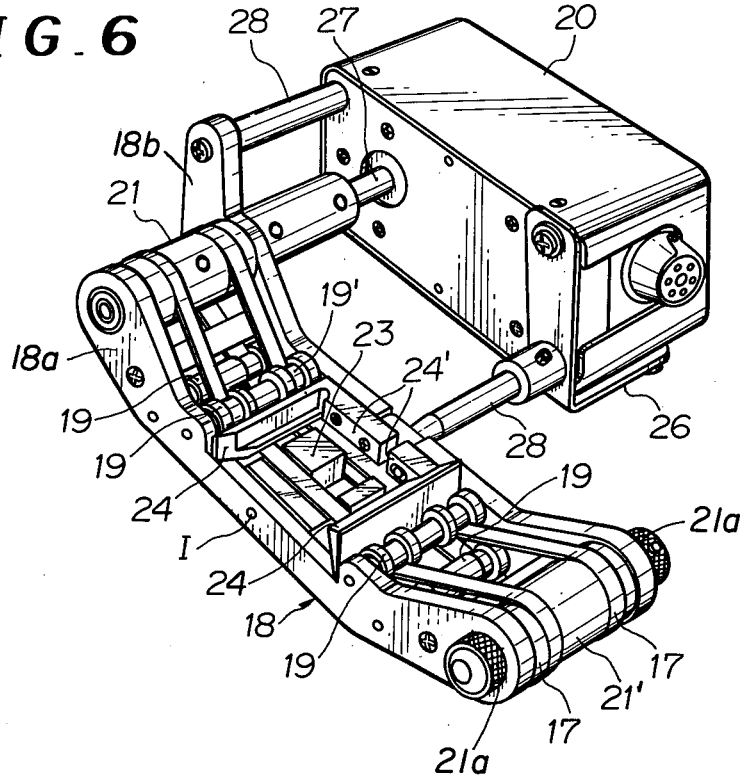
Figure 7:
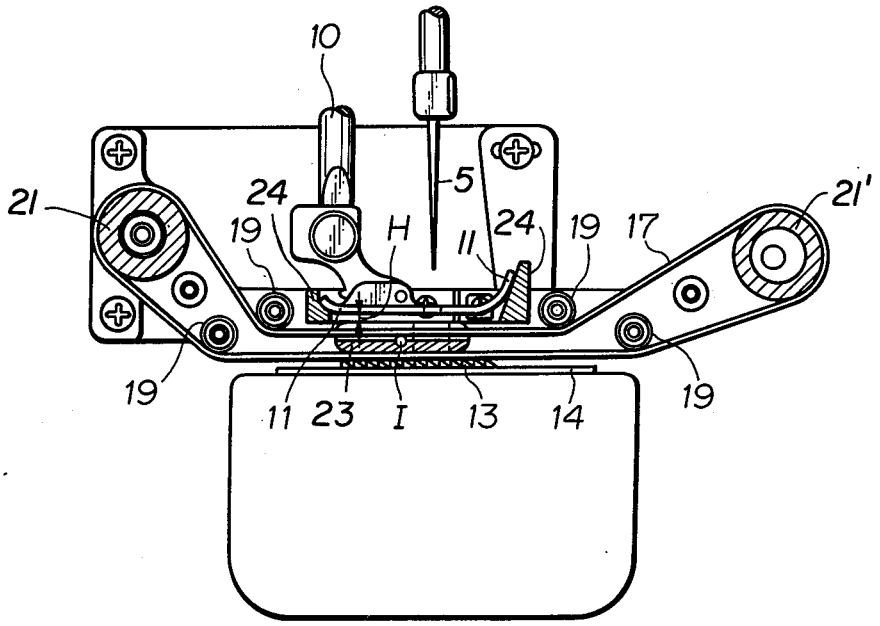

FIG. *2a–2e* depict five exemplary stitch patterns, referred to in the course of explanation;

FIG. 3 depicts the essential components of the transducer used to sense the transversely displaced position of the needle of the sewing machine of FIG. 1;

FIG. 4 depicts part of the conventional cloth-feeder unit of the sewing machine of FIG. 1;

FIG. 5 depicts the motions described by the feed dog 13 of the cloth-feeder unit of FIG. 4, for forwards cloth-feeding action and for reverse cloth-feeding action;

FIG. 6 depicts, in perspective view, a transducer attachment utilized for the generation of information simulating the amount of successive feed increments which would be implemented during the sewing of an actual cloth workpiece; and FIG. 7 is a side view of the structure shown in FIG. 6, partly in vertical section.

DETAILED DESCRIPTION OF THE INVENTION

FIG. 1 is a perspective depiction of the overall appearance of a system such as contemplated by the invention. The system includes a sewing machine 1 provided with transducers operative for generating electrical signals indicating the transversely displaced position of the machine's needle and the increment of cloth feed effected by the machine's cloth-feeder unit; a converter 8 operative for converting the transducer signals into a form suitable for application to the x- and y-inputs of an x-y recorder; and an x-y recorder 9, here in the form of a recording or persistent-image oscilloscope comprised of a cathode-ray tube 25 and adjustable with respect to the scale of its display.

The sewing machine 1 is provided with a conventional needle bar support 2 mounted swingable about a pivot shaft 3 for effecting transverse displacement of the machine's needle bar 4, to the end of which latter the needle 5 proper is secured. As shown in FIG. 3, the needle bar support member 2 is provided with a screwed-on ferromagnetic member 22, forming part of a displacement transducer operative for generating a signal indicative of the transversely displaced position of the machine's needle. The remainder of the transverse-displacement transducer is constituted by a coil 6 energized by high-frequency current. Such displacement transducers are conventional; depending upon the distance between high-frequency coil 6 and ferromagnetic member 22, i.e., depending upon the amount of the transverse displacement of needle bar 4, the magnetic permeability of the path through which the lines of flux emanating from coil 6 extend is increased or decreased, thereby modifying the voltage across the coil 6; or, as another familiar alternative, the coil 6 can generate a signal indicating the degree of proximity of ferromagnetic member 22 by reliance upon eddy-current energy dissipation within the material of ferromagnetic member 22, the amount of energy supplied to the coil 22 and dissipated in the form of eddy-current losses being dependent upon the distance between coil 6 and ferromagnetic member 22. As shown in FIG. 1, coil 6 is mounted on an arm-like attachment 7 secured to the housing of sewing machine 1. The terminals of coil 6 are connected to the signal converter 8 for signal-processing purposes, i.e., to convert the coil's signal into a form suitable for application to the y-input of the x-y recorder 9.

The displacement transducer 6, 22 shown in FIGS. 1 and 3 is of the contactless type, i.e., not involving physical contact between stationary and moving components of the transducer. However, alternatively, use could of course be made of a transducer of the physical-contact type.

FIG. 4 depicts the relevant components of a conventional sewing-machine cloth-feeder unit. The cloth-feeder unit comprises a presser bar 10, to whose lower end is articulately connected a presser foot 11. In the ordinary way, when sewn material is to be removed from the machine, the machine's needle is raised and the presser bar 10 then lifted upwards to elevate the presser foot 11. Numeral 12 denotes a cloth workpiece located beneath presser foot 11 and resting on a needle plate 14. In the ordinary way, a feed dog 13 projects upwardly beyond the level of needle plate 14 through an aperture in the needle plate and grips the underside of the cloth workpiece 12 for cloth-feeding purposes, with the workpiece clamped between presser foot 11 and feed dog 13. As conventional, during cloth-feeding action, the feed dog 13 describes a path of movement such as shown in FIG. 5, at 15 for forwards-feeding action and at 16 for reverse-feeding action, the presser foot 11 being constrained to move a distance G above the level of the needle plate 14 or, equivalently, the workpiece 12 resting thereon.

The cloth is generally fed as shown in FIG. 4. The cloth being sewn is pressed by a presser foot 11 attached to a presser bar 10 at its lower end, and when the sewing machine is driven, a feed dog 13 clamps the cloth 12 with respect to the presser foot 11 and moves the cloth forward and backward on a needle plate 14 while drawing loci 15 and 16 as shown in FIG. 5. A locus at the forward movement is shown with 15, and that at the backward movement is 16. At this time, in order for the feed dog 13 to draw the loci 15 and 16, there is vertically a distance G between the presser foot 11 and the cloth 12.

In this invention, a special device is used as described in the following to accurately catch the feeding amount of the cloth.

As shown in FIG. 1, there is furthermore provided an attachment 18, 20 which serves as a transducer generating information concerning the amounts which the successively performed cloth-feed increment would have, if a cloth workpiece were actually present in the machine. This attachment is shown in detail, in perspective view, in FIG. 6 and is shown in FIG. 7 in a side view, partly in vertical section.

Attachment 18 comprises two side plates **18*a*, 18*b* which mount a plurality of rollers 19, 21, 21', about which are trained two endless belts 17. As shown particularly clearly in FIG. 7, the lower runs of the two endless belts 17 are engaged by the cloth feed dog 13 of the machine's cloth-feeder unit, and accordingly take the place of a cloth workpiece being fed by the feed dog 13. The increments by which the feed dog 13 advances the endless belts 17** are converted, as explained below, into signals indicating what amounts of actual cloth feed increment would result, if a cloth workpiece were actually being sewn.

The rollers 19, 21, 21' about which the two endless belts 17 are entrained include four guide rollers 19 (see FIG. 7) provided with annular belt-guiding grooves 19' (see FIG. 6). The two belts 17 are furthermore guided around turn-over rollers 21 and 21' provided at respective ends of the pair of side plates **18*a*, 18*b*. As shown most clearly in FIG. 7, the turn-over roller 21' is provided with an eccentrically mounted rotation shaft and, as shown in FIG. 6, its rotation shaft is provided with knurled knobs 21*a* which can be turned to eccentrically turn the rotation shaft of roller 21', i.e., for occasional adjustment of the tension of the two endless belts 17**.

The attachment 18 furthermore includes a belt presser member 23. As shown in FIG. 6, the upper face of the belt presser member 23 is provided with two lengthwise extending guidance recesses, within which the upper runs of respective ones of the two endless belts 17 extend. The lower runs of the two endless belts 17 extend along the underface of belt presser member 23, as shown particularly clearly in FIG. 7. As shown in FIG. 6, the portion of presser member 23 located between the upper runs of the two belts 17 is interrupted, to form an aperture through which the machine's needle 5 can pass, as shown in FIG. 7. The purpose of belt presser member 23 is, first, to guide the upper runs of the belts 17 at the portion thereof shown in FIG. 6, and as shown in FIG. 7 to press the corresponding portion of the lower runs of the belts 17 against and into gripping engagement with the teeth of the feed dog 13 of the machine's cloth-feeder unit. As shown in both FIGS. 6 and 7, the belt presser member 23 is pivotally mounted about a transversely extending pivot pin I whose two end are mounted in the side plates **18*a*, 18*b* of the attachment 18. This is done so that the underface of the belt presser member 23 have a certain amount of pivotal play, i.e., simulating the pivotal play which would be exhibited by the machine's actual presser foot 11, if the latter were pressing a cloth workpiece down into engagement with the teeth on feed dog 13**.

Attachment 18 furthermore comprises a support member 24 for the presser foot 11 of the sewing machine 1. Presser-foot support member 24 is, as shown in FIG. 6, essentially a U-shaped structure screwed to the side plate **18*b* of attachment 18. In the illustrated embodiment, the presser-foot support member 24 consists of two elements, the right one of which is shiftably mounted (see the elongated slot in the right arm of right element 24 in FIG. 6), so that the distance between the two legs of the U-shaped structure 24, 24 can be adjusted, if ever necessary, to accommodate a presser foot 11 (see FIG. 7) of another length. As shown in FIG. 7, when the presser bar 10 and accordingly the presser foot 11 are lowered, i.e., just as if a cloth workpiece were present, towards their usual operative position, the machine's presser foot 11 comes to a rest on and is supported by the inner surfaces of the presser-foot support member 24, the inner surfaces of presser-foot support member 24 being denoted in toto by numerals 24' in FIG. 6**.

During operation, the endless belts 17 are incrementally advanced forwards and backwards by the feed dog 13 by amounts virtually identical to the amounts by which a cloth workpiece would be thusly fed. As the belts 17 are driven in this manner, they rotate guide roller 21 in one or the other direction, depending upon whether a forwards or a reverse feed increment is being performed. Guide roller 21, in turn, rotates a transmission shaft 27 which drives a (non-illustrated) rotary transducer internal to a transducer unit 20. Transducer unit 20, in turn, generates an electrical signal indicating the angular increment of rotation of transmission shaft 27, and in that way the increment of feed of the endless belts 17. Such signal is then applied to the converter 8 of FIG. 1. The converter 8 converts such signal into a form suitable for application to the x-input of x-y recorder 9. In this way, the increments of cloth feed which would result when an actual cloth workpiece is involved can be displayed on the cathode-ray tube 25 of recorder 9 for evaluation.

Attachment 18 is mounted on transducer unit 20 by means of two mounting rods 28. The right mounting rod 28 (as viewed in FIG. 6) is secured to the housing of transducer unit 20 through the intermediary of an angled spring element screwed onto the housing of transducer unit 20. This serves to deliberately introduce a certain amount of play into attachment 18, i.e., so that the belt presser member 23 thereof press the belts 17 against feed dog 13 in response to the machine's presser foot 11 pressing down against the presser-foot support member 24 of attachment 18.

Accordingly, the the x- and y-input signals of recorder 9 can be used to generate a display, on a larger than real-life scale, of the stitch pattern which would be formed, without the usual resort to trial-and-error work performed on actual cloth workpieces.

Also, the present invention is of utility, not merely in the setting-up work incident to the establishment of a complex stitch pattern, but furthermore to test the accuracy of operation of various sewing-machine components, for example to test the accuracy of operation of the machine's needle system and its cloth-feeder unit per se.

Additionally, it will be evident that the concepts of the present invention are not limited to sewing machine designs of the exact type here illustrated.

I claim:

1. For use with a sewing machine of the type comprising a cloth-feeder unit provided with a feed dog and a presser foot between which a cloth workpiece to be sewn would be clamped and incrementally advanced forwards and backwards by the feed dog, a transducer system operative for generating information concerning the amounts of the forwards and backwards cloth-feed increments, the transducer system comprising, in combination, at least one cloth-simulating element serving to simulate the presence of a cloth workpiece; mounting means mounting the cloth-simulating element such that the cloth-simulating element be incrementally fed forwards and backwards by the feed dog of such sewing machine; and means operative for converting the incremental motions performed by the cloth-simulating element into corresponding electrical signals.

2. The transducer system defined in claim 1, and at least one cloth-simulating element being at least one endless belt, the mounting means comprising a plurality of guide rollers entraining the endless belt.

3. The transducer system defined in claim 2, the means converting the incremental motions into corresponding electrical signals comprising a rotary shaft driven by the at least one endless belt.

4. The transducer system defined in claim 2, the mounting means including a belt presser member located such that a run of the endless belt travel between the feed dog of such sewing machine and the belt presser member, the belt presser member serving to simulate the role of the presser foot of such sewing machine.

5. The transducer system defined in claim 4, the mounting means including pivotal mounting means mounting the belt presser member for pivotal movement about a pivot axis extending transverse to the endless belt, serving to simulate the pivotal mounting of a sewing machine's presser foot.

6. The transducer system defined in claim 5, the mounting means furthermore including a presser-foot support member shaped and located such as to accommodate a sewing machine's presser foot in a predetermined position.

7. The transducer system defined in claim 4, the mounting means furthermore including a presser-foot support member shaped and located such as to accommodate a sewing machine's presser foot in a predetermined position.

8. The transducer system defined in claim 1, the mounting means including means defining a space so shaped and located as to accommodate the presser foot of a sewing machine.

9. The transducer system defined in claim 1, furthermore including signal-processing means operative for converting the electrical signals into a form suitable for application to a display device, and a display device receiving the converted electrical signals and generating a visual display of information concerning the increments of forwards and backwards feed of the cloth-simulating element.

* * * * *